US006981598B1

(12) United States Patent
Rivera et al.

(10) Patent No.: US 6,981,598 B1
(45) Date of Patent: Jan. 3, 2006

(54) TURN-TABLE DUAL HOISTING CRANE

(75) Inventors: Rafael Rivera, Magnolia, NJ (US); Christopher Clemmer, Allentown, PA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 112 days.

(21) Appl. No.: 10/758,560

(22) Filed: Jan. 16, 2004

Related U.S. Application Data

(60) Provisional application No. 60/506,404, filed on Sep. 26, 2003.

(51) Int. Cl.
*B66C 19/00* (2006.01)

(52) U.S. Cl. ..... 212/325; 212/312

(58) Field of Classification Search ..... 104/35, 104/98, 99, 130.6; 212/312, 316, 324, 325, 212/315

See application file for complete search history.

(56) References Cited

U.S. PATENT DOCUMENTS

| | | | | | |
|---|---|---|---|---|---|
| 979,469 | A | * | 12/1910 | Gilman | 104/92 |
| 1,111,100 | A | * | 9/1914 | Sawyer | 212/286 |
| 1,327,071 | A | * | 1/1920 | Taylor | 104/91 |
| 1,436,861 | A | * | 11/1922 | Collins | 212/316 |
| 1,443,382 | A | * | 1/1923 | Rapier | 104/98 |
| 1,481,404 | A | * | 1/1924 | Wright | 414/348 |
| 4,750,429 | A | * | 6/1988 | Mordaunt et al. | 104/98 |

* cited by examiner

*Primary Examiner*—Thomas J. Brahan
(74) *Attorney, Agent, or Firm*—Jacob Shuster

(57) ABSTRACT

Containers are respectively loaded onto and delivered from two trolleys of a single crane at pick-up and delivery locations by guided travel of one of the trolleys along a fixed travel path on a boom between the delivery location at one end of the boom and a turn-table platform of the crane on which a pair of angularly related track paths are established for alternative alignment with the fixed travel path on the boom, to accommodate transfer of the trolleys between such fixed travel path and either one of the track paths on the platform.

4 Claims, 3 Drawing Sheets

FIG. 3
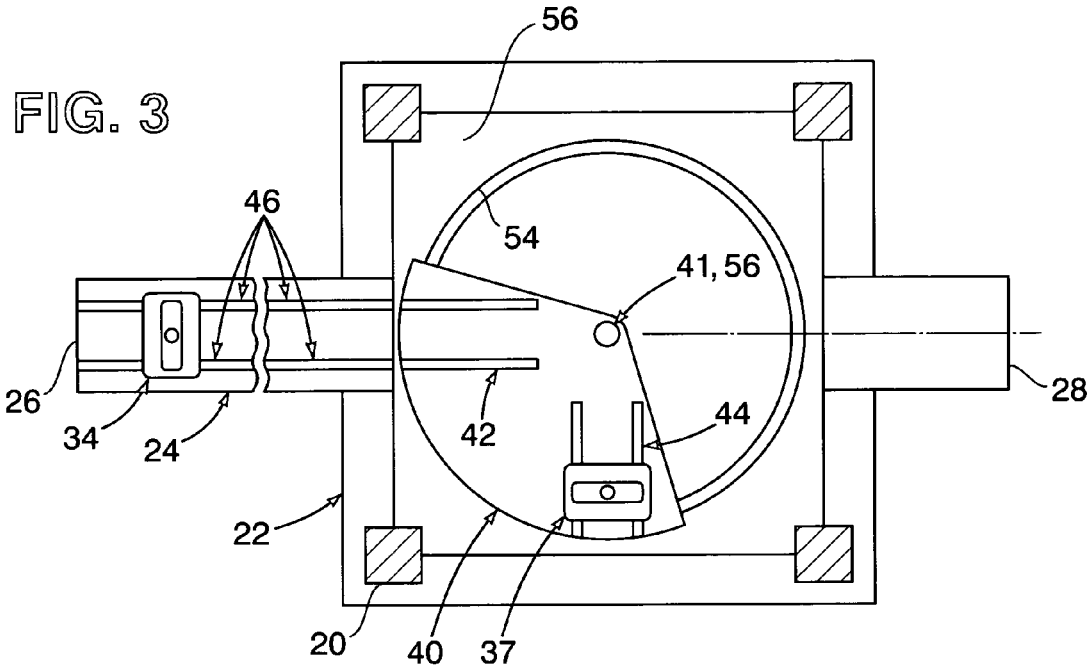
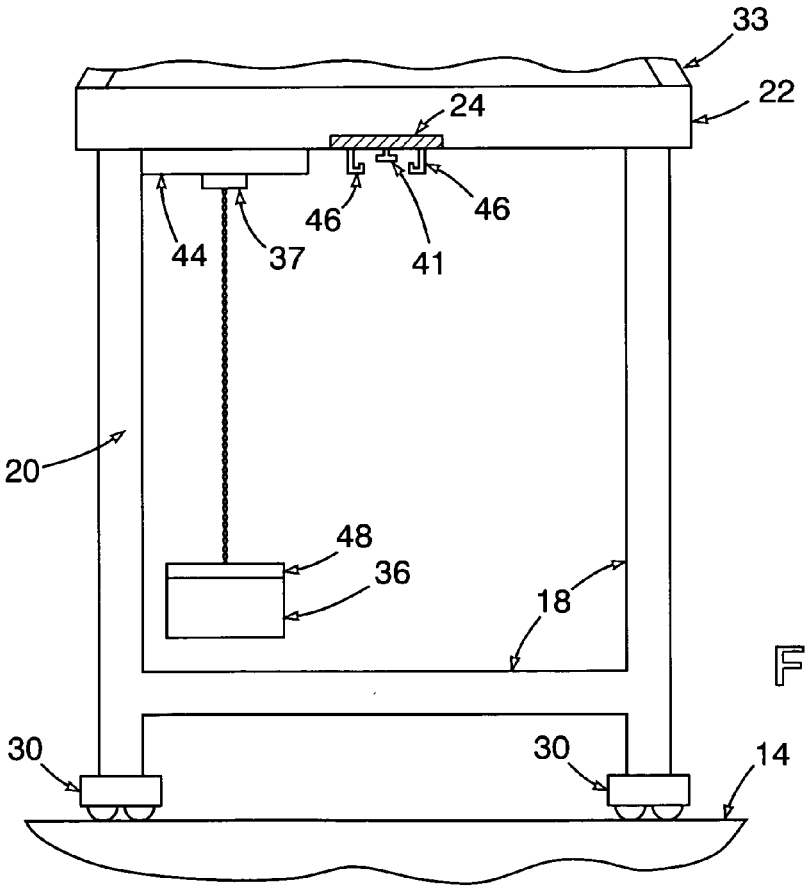
FIG. 4

FIG. 5
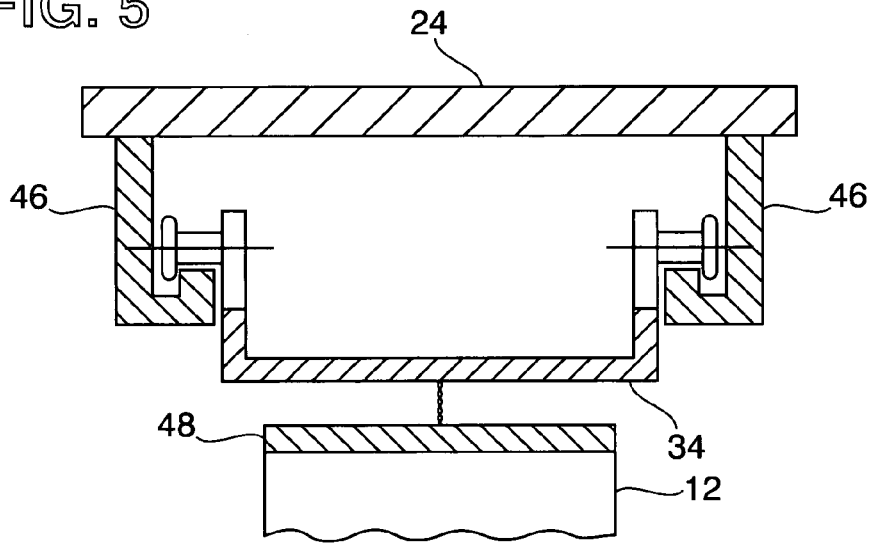
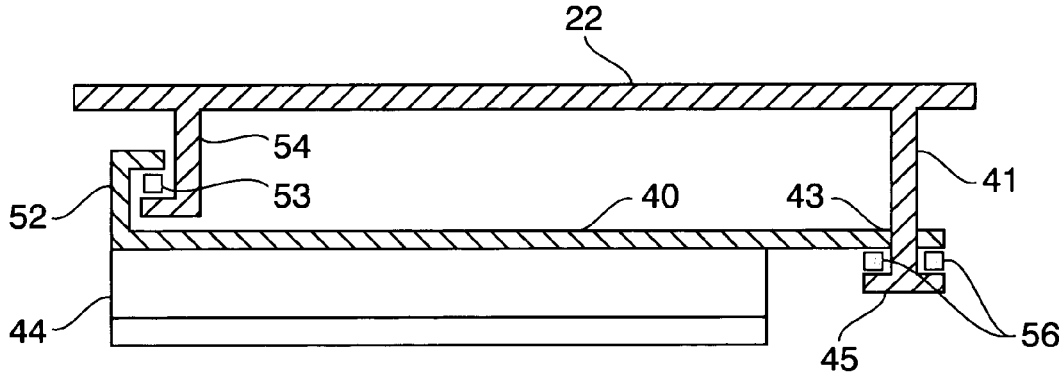
FIG. 6

TURN-TABLE DUAL HOISTING CRANE

CROSS-REFERENCE TO RELATED APPLICATION

This application claims the benefit of U.S. Provisional Application No. 60/506,404 filed Sep. 26, 2003, entitled "TURN-TABLE DUAL HOISTING CRANE", incorporated herein by reference.

STATEMENT OF GOVERNMENT INTEREST

The invention described herein may be manufactured and used by or for the Government of the United States of America for governmental purposes without the payment of any royalties thereon or therefore.

The present invention relates to the transport of containers on a crane between land-based delivery and dockside sea vessel pick-up locations.

BACKGROUND OF THE INVENTION

Current facilities for transport of containers between land and ships involve large marine terminal cranes, which typically embody one trolley traveling along the length of a boom for pick-up and delivery of the containers. While such cranes may be adequate for low demand at small scale sea ports, at larger ports such cranes are a disrupting bottleneck to terminal activities, which call for additional equipment and cranes to avoid delays in port traffic and container transfer. It is therefore an important object of the present invention to provide for a more efficient and less time-consuming transfer of containers from trucks to ships through the aforementioned type of marine terminal crane.

SUMMARY OF THE INVENTION

Pursuant to the present invention, a single crane is provided through which repeated cycles of two simultaneously functioning trolleys may be moved along a fixed boom rail path and one of two 90° related rail paths on a turn-table platform pivotally mounted for rotation about an axis at the intersection of such platform rail paths so as to accommodate transfer of each trolley between the fixed boom rail path and either one of the two platform rail paths positioned in alignment therewith by angular displacement of the turn-table platform. One of the trolleys may thereby be cyclically emptied or loaded from one end of the boom while the other trolley is either loaded with a container or emptied at one of the two positions underlying the platform.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein:

FIG. 3 is a section view taken substantially through a plane indicated by section line 3—3 in FIG. 1; and;

FIGS. 4, 5 and 6 are section views taken substantially through planes indicated by lines 4—4, 5—5 and 6—6 in FIG. 2.

DETAILED DESCRIPTION OF PREFERRED EMBODIMENT

Figure 1:
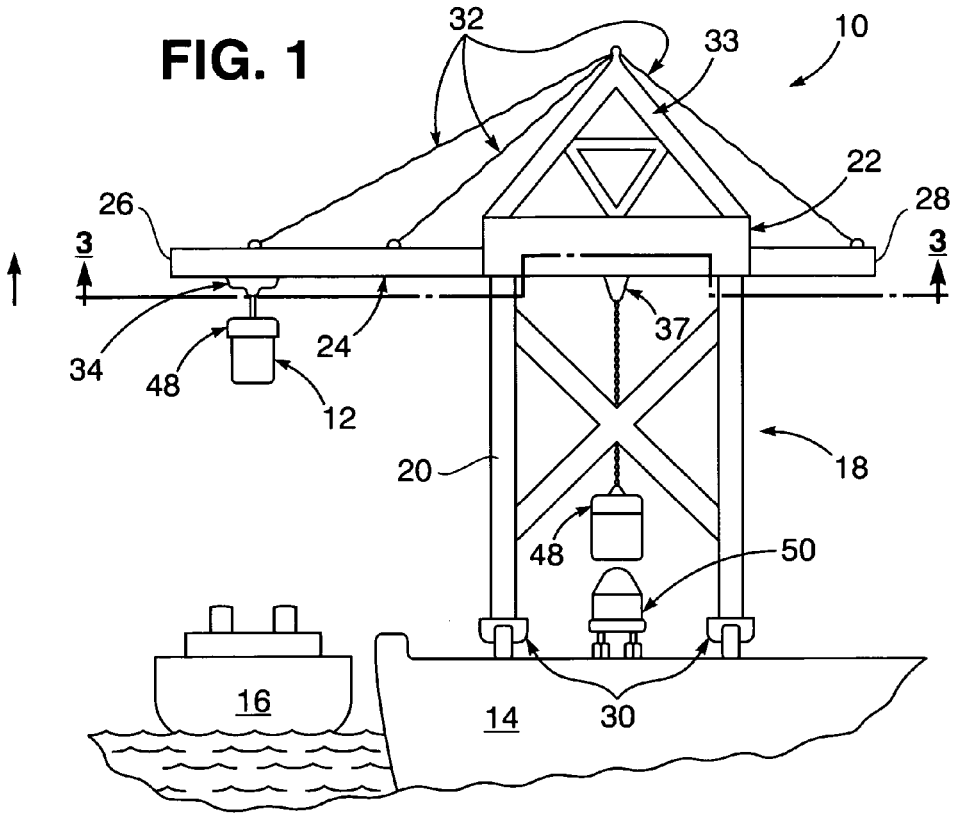
FIG. 1 is a side elevation view of a crane constructed in accordance with one embodiment of the present invention.
Figure 2:
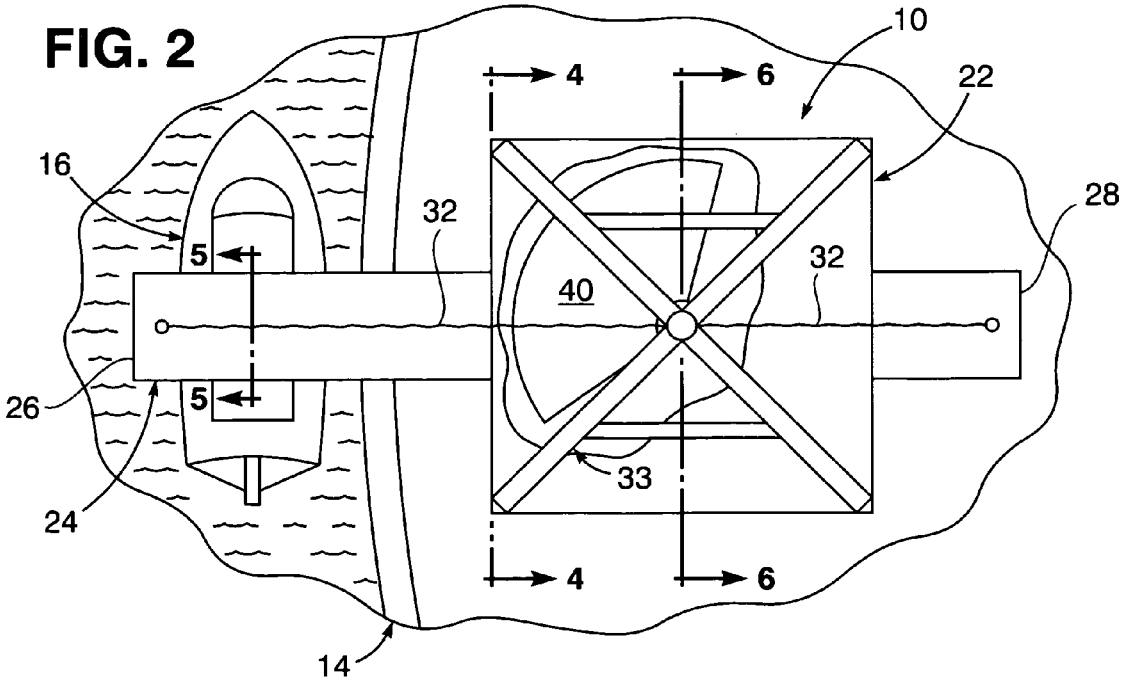
FIG. 2 is a top plan view of the crane illustrated in FIG. 1, with a cut-away section thereof exposing a turntable.

Referring now to the drawing in detail, FIGS. 1 and 2 illustrate a crane 10 adapted to be moved to a position for transfer of standard containers, such as a container 12 between pick-up and delivery locations such as a land-based pier 14 and dockside sea vessels 16. The crane 10 has a support frame 18 embodying four vertical gantry legs 20 interconnected in spaced relation to each other so as to support on their upper ends a rectangular central structure 22 in a horizontal position. An elongated boom 24 extends horizontally from the central structural 22. Opposite ends 26 and 28 of the boom 24 are spaced from the central structure 22 by different amounts. The boom end 26 is spaced a sufficient distance from the central structure 22 so as to accommodate container delivery thereat when the crane 10 is appropriately positioned by motorized wheel assemblies 30 at the lower ends of the crane gantry legs 20. Support cables 32 attached to the top of an anchor 33 fixed to the central structure 22 maintains the boom 24 in its horizontal position by connection of the lower ends of the cables 32 to the boom 24 adjacent to its opposite ends 26 and 28.

The container 12 and a spreader bar 48 are suspended below the boom 24 from one trolley 34 for travel along a path on the underside of the boom 24 between its end 26 and the central structure 22. A second container 36 and spreader bar 48 are suspended below the central structure 22 from a second trolley 37 mounted below a turntable type of switching platform 40 as hereinafter explained.

As shown in FIG. 3, the platform 40 is pivotally mounted by a post 41 and central bearing 56 from the structure 22, with the underside of the platform 40 exposed below the structure 22. Two pairs of tracks 42 and 44 are formed on such underside of the platform 40 to establish a pair of trolley travel paths which may be alternatively aligned with a fixed travel path established along the underside of the boom 24 by fixed tracks 46. The trolleys 34 and 37 are respectively suspended from the tracks 46 on the boom 24 and the tracks 42 or 44 on the platform 40 as shown in FIGS. 3, 4 and 5. The spreader bars 48 respectively connect the trolleys 34 and 37 to the containers 12 and 36. When either one of the platform tracks 42 and 44 is aligned with the fixed boom tracks 46 as shown in FIG. 3, the trolley 34 or 37 with its spreader bar 48 may be switched between the boom tracks 46 and the platform tracks 42 or 44 so as to thereby transfer the container 12 or 36 between the underside travel paths on the boom 24 and the platform 40, after which the platform 40 may be angularly displaced from the position shown in FIGS. 2 and 3 toward another position at right angles thereto for realignment of the track 42 or 44 with the fixed boom track 46. Such angular movement of the platform 40 in opposite directions accommodates cyclic transfer of both of the trolleys 34 and 37 between the boom 24 and the platform 40 as hereinafter explained. The turn-table platform 40 has a radially outer rim 52 guidingly supported by bearings 53 on an angular track 54 projecting downwardly from the bottom surface of the structure 22 as shown in FIG. 6. The turn-table platform 40 is centrally suspended from the post 41 projecting downwardly from the bottom surface of the structure 22. The platform 40 rotates about a central pivot hole 43 guidingly supported by bearings 56 on post end 45.

An operational cycle of the crane 10 may be initiated for loading of the sea vessel 16 when one of the two trolleys 34 and 37 with its spreader bar 48 suspended below the platform 40 is picking up the container 12 or 36 at the land-based pier 14 from a vehicle 50 as shown in FIG. 1, while the other trolley 34 or 37 is located adjacent the end 26 of the boom 24 for container drop off onto the dockside sea vessel 16 at the delivery location. The trolley 34 or 37 when emptied is then moved along the fixed boom tracks 46 back to the platform 40 for transfer onto the empty platform tracks 42 or 44. The platform 40 is then rotated 90° under powered drive in a counter-clockwise direction for example from its position as shown in FIG. 2 by motorized means to displace the emptied trolley 34 or 37 thereon out of alignment with the fixed boom tracks 46, while the platform tracks 44 with the container laden trolley 34 or 37 is brought into alignment with the fixed boom tracks 46 to permit the trolley 34 or 37 to begin its journey toward the forward end 26 of the boom 24 for container delivery thereat. During such rotation of the platform 40 the container 12 or 36 is angularly displaced through its spreader 48 relative to the trolley 34 or 37 to avoid obstruction thereof by the crane legs 22 during trolley movement along the platform tracks 42 or 44. The emptied trolley 34 or 37 on the platform 40 will then be positioned for container pick-up to complete one half of a cycle. The latter half-cycle process is repeated in a reverse direction to complete a full cycle with repositioning of the trolleys 34 and 37 on the crane 10 at the pick-up and delivery locations. Upon completion of each of such full cycles, the entire cycle may be repeated in order to accommodate container transfer between ships and piers by use of the single crane 10 with a significantly increased productivity. The foregoing described process may be reversed when desired with the pick-up location on the dockside sea vessel 16 while the land-based vehicle 50 is the delivery location, so as to unload the sea vessel 16.

Obviously, other modifications and variations of the present invention may be possible in light of the foregoing teachings. It is therefore to be understood that within the scope of the appended claims the invention may be practiced otherwise than as specifically described.

What is claimed is:

1. A crane for cyclic transfer of two containers between pick-up and delivery locations, comprising: an elongated boom having a fixed travel path established thereon; frame means for support of the boom with said fixed travel path extending in operative relationship between said pick-up and said delivery locations; a platform having a pair of track paths established thereon; means pivotally mounting the platform on the frame means for angular displacement about a rotational axis at an intersection between said pair of track paths relative to the boom; a pair of trolleys onto which the containers are loaded at the pick-up location and unloaded at the delivery location; and spreader means for respectively suspending said two containers from said pair of trolleys to accommodate transfer thereof between the fixed travel path on the boom and either one of said pair of the travel paths on the platform extending from said intersection in angular relation to each other.

2. The crane as defined in claim 1, wherein said frame means includes: gantry legs having upper ends on which the platform mounting means and the boom are supported; said legs having lower ends connected to wheeled trucks through which the crane is movably positioned to establish said operative relationship of the fixed travel path between the pick-up and the delivery locations.

3. A crane through which two trolleys transfer loads between pick-up and delivery locations, comprising: a frame; an elongated boom fixedly mounted on the frame; a platform; track means respectively mounted on the boom and the platform for guiding travel of the trolleys along a fixed travel path on the boom and a pair of travel paths on the platform extending in angular relation to each other from an intersection on the platform; and means pivotally mounting the platform on the frame for displacement of said pair of the travel paths on the platform about a rotational axis at said intersection of the travel paths into and out of alignment with the fixed travel path on the boom to accommodate transfer of said trolleys between the fixed travel path and either one of the pair of the travel paths on the platform in alignment therewith.

4. The crane as defined in claim 3, wherein said boom projects from the frame to one of the pick-up and delivery locations, while one of said pair of the travel paths on the platform out of alignment with the fixed travel path is positioned above the other of the pick-up and delivery locations.

* * * * *